US011445876B2

(12) United States Patent
Kim et al.

(10) Patent No.: US 11,445,876 B2
(45) Date of Patent: Sep. 20, 2022

(54) CLEANER

(71) Applicant: Samsung Electronics Co., Ltd., Suwon-si (KR)

(72) Inventors: Yeon Su Kim, Seoul (KR); Jae Won Choi, Seoul (KR); Jae Ho Jang, Seoul (KR); Seung Wook Suh, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 118 days.

(21) Appl. No.: 16/641,361

(22) PCT Filed: Aug. 1, 2018

(86) PCT No.: PCT/KR2018/008745
§ 371 (c)(1),
(2) Date: Feb. 24, 2020

(87) PCT Pub. No.: WO2019/039764
PCT Pub. Date: Feb. 28, 2019

(65) Prior Publication Data

US 2020/0221914 A1 Jul. 16, 2020

(30) Foreign Application Priority Data

Aug. 22, 2017 (KR) ..... 10-2017-0106195

(51) Int. Cl.
*A47L 9/04* (2006.01)
*A47L 9/24* (2006.01)
(Continued)

(52) U.S. Cl.
CPC ..... *A47L 9/04* (2013.01); *A47L 9/242* (2013.01); *A47L 5/26* (2013.01); *A47L 5/30* (2013.01); *A47L 9/009* (2013.01); *A47L 9/1683* (2013.01)

(58) Field of Classification Search
CPC . A47L 9/04; A47L 9/242; A47L 9/009; A47L 9/1683; A47L 9/02; A47L 9/0461;
(Continued)

(56) References Cited

U.S. PATENT DOCUMENTS 2,963,750 A * 12/1960 Pavlic ..... A47L 9/2857 156/144
4,204,297 A * 5/1980 Yasunaga ..... A47L 9/0411 15/323
(Continued)

FOREIGN PATENT DOCUMENTS

CN 105592764 A 5/2016
CN 206365853 U 8/2017
(Continued)

OTHER PUBLICATIONS

Chinese Office Action dated Mar. 3, 2021, issued in Chinese Patent Application No. 201880053891.3.
(Continued)

*Primary Examiner* — Monica S Carter
*Assistant Examiner* — Michael A Gump
(74) *Attorney, Agent, or Firm* — Jefferson IP Law, LLP

(57) ABSTRACT

The present disclosure relates to a cleaner including an improved structure to enable self-standing. The cleaner includes a head main body including a brush, a main wheel coupled to the head main body to be positioned in the rear of the brush, a suction pipe disposed between the brush and the main wheel to enable self-standing, a connector configured to connect the suction pipe and the head main body, and a hose having an elasticity such that the suction pipe maintains a self-standing state and disposed between the head main body and the connector.

16 Claims, 10 Drawing Sheets

(51) Int. Cl.

| | |
|---|---|
| *A47L 5/26* | (2006.01) |
| *A47L 5/30* | (2006.01) |
| *A47L 9/00* | (2006.01) |
| *A47L 9/16* | (2006.01) |

(58) Field of Classification Search

CPC ..... A47L 9/0477; A47L 9/24; A47L 9/244; A47L 9/248; A47L 9/327; A47L 5/26; A47L 5/30; A47L 5/225; A47L 5/24; A47L 5/32; A47L 5/36; A47L 5/365

USPC ..... 15/383

See application file for complete search history.

(56) References Cited

U.S. PATENT DOCUMENTS

| | | | | |
|---|---|---|---|---|
| 2004/0187254 | A1* | 9/2004 | Fedorka | A47L 9/0477 15/384 |
| 2010/0088842 | A1* | 4/2010 | Worker | A47L 9/009 15/353 |
| 2014/0345079 | A1 | 11/2014 | Johnson et al. | |
| 2015/0067981 | A1* | 3/2015 | Faremo | A47L 9/0054 15/354 |
| 2016/0174792 | A1* | 6/2016 | Williamson | A47L 9/0477 15/383 |
| 2017/0071434 | A1* | 3/2017 | Nguyen | A47L 11/4044 |
| 2019/0150686 | A1* | 5/2019 | Horne | A47L 9/02 |
| 2019/0313872 | A1* | 10/2019 | Ward | A47L 9/2868 |
| 2020/0000304 | A1* | 1/2020 | Holmes | A47L 11/4036 |

FOREIGN PATENT DOCUMENTS

| | | | |
|---|---|---|---|
| EP | 1 985 218 | A1 | 10/2008 |
| JP | 2002-102126 | A | 4/2002 |
| JP | 2007-000465 | A | 1/2007 |
| JP | 2016-137164 | A | 8/2016 |
| KR | 10-1998-0021838 | A | 6/1998 |
| KR | 10-2007-0059286 | A | 6/2007 |
| KR | 10-2016-0025245 | A | 3/2016 |
| KR | 10-2016-0037235 | A | 4/2016 |
| KR | 10-1643680 | B1 | 7/2016 |

OTHER PUBLICATIONS

Extended European Search Report dated Mar. 11, 2020, issued in European Patent Application No. 18849189.8.

Korean Office Action dated Jul. 22, 2021, issued in Korean Patent Application No. 10-2017-0106195.

* cited by examiner

CLEANER

TECHNICAL FIELD

The present disclosure relates to a cleaner, and more particularly, to a cleaner including an improved structure to enable self-standing.

BACKGROUND ART

A cleaner is a device that cleans a room by removing foreign substances in the room, and a vacuum cleaner may be generally used at home.

In general, the vacuum cleaner is a device that may perform cleaning by generating a suction force and sucking foreign substances such as dust together with air and then removing the foreign substances using a dust collector provided inside a cleaner main body.

The vacuum cleaner includes a cleaner main body in which a blower, a dust collector, and the like are installed, a cleaner head installed separately from the cleaner main body to suck dust on a floor, and a suction pipe for connecting the cleaner main body and the cleaner head.

A user may clean while holding a handle and moving the cleaner head in a direction to be cleaned.

The vacuum cleaner includes a handheld cleaner that is configured such that a motor, a cyclone, a filter, the handle, and the like, which are core components of the vacuum cleaner, are disposed in the cleaner main body and the cleaner head and the cleaner main body are connected by the suction pipe, and the handheld cleaner may be used as a handy cleaner in a case where the suction pipe is separated from the cleaner main body and an accessory is inserted into the cleaner main body.

A brush of the handheld cleaner is connected to the suction pipe by a connection portion and may be steered by a joint of the connection portion that may move left and right or back and forth.

When the handheld cleaner performs the cleaning, changeover between a situation of cleaning the floor by mounting the brush and a situation of cleaning places other than the floor by mounting the accessory may occur frequently.

In general, the handheld cleaner has a structure in which the suction pipe to connect the cleaner main body and the cleaner head is disposed in the rear of the cleaner head, whereby the center of gravity of the suction pipe is located at an edge of the cleaner head instead of the center of the cleaner head.

Therefore, the handheld cleaner has a structure in which self-standing of the suction pipe is difficult when the suction pipe is separated from the cleaner main body.

For this reason, when the suction pipe is separated from the cleaner main body to replace the brush with the accessory, the suction pipe loses its center of gravity and falls down to the ground, which leads to an accident, or a user suffers the inconvenience of having to bend the back of the user and put the separated suction pipe down on the ground.

DISCLOSURE

Technical Problem

The present disclosure is directed to providing a cleaner including an improved structure to enable self-standing.

The present disclosure is directed to providing a cleaner including an improved hose so that the self-standing of the suction pipe may be maintained.

Technical Solution

One aspect of the present disclosure provides a cleaner including a head main body including a brush, a main wheel coupled to the head main body to be positioned in the rear of the brush, a suction pipe disposed between the brush and the main wheel to enable self-standing, a connector configured to connect the suction pipe and the head main body, and a hose having an elasticity such that the suction pipe maintains a self-standing state and disposed between the head main body and the connector.

The brush may include a front brush and a rear brush disposed in the rear of the front brush in parallel with the front brush, and the suction pipe may be disposed between the front brush and the main wheel.

The suction pipe may be positioned vertically above the rear brush.

The hose and the suction pipe may be positioned vertically in a straight line.

The hose may include a bellows with pleats.

The head main body may include a brush body to receive the brush and a brush housing to cover the brush body, and the main wheel cleaner may be rotatably coupled to the brush housing.

The connector may include a first connector to connect the suction pipe and the hose and a second connector to connect the first connector and the brush housing.

The second connector may be rotatably coupled to the brush housing to allow the suction pipe to rotate in the front and rear directions.

The second connector and the main wheel may be rotatably arranged coaxially.

The brush housing may include a first brush housing configured to cover the brush body and a second brush housing configured to extend rearward from the first brush housing, and the main wheel, the second brush housing and the second connector may be horizontally positioned in a straight line.

The first connector may be rotatably coupled to the second connector to allow the suction pipe to rotate in the left and right directions.

The first connector may be positioned vertically in a straight line with the hose and the suction pipe, and the second connector may be disposed above the main wheel.

The one end of the hose may be coupled to the first brush housing, the other end of the hose may be coupled to the first connector.

The first connector may include a suction pipe coupling portion detachably coupled to the suction pipe, a second connector coupling portion rotatably coupled to the second connector, and a hose receiving portion to receive the hose.

The second connector may include a first connector coupling portion coupled to the first connector, and a rotation portion rotatably coupled to the second brush housing.

Advantageous Effects

According to the present disclosure, the convenience of use of a cleaner can be improved by improving the structure to enable stable self-standing of a suction pipe.

According to the present disclosure, storage and management of the cleaner can be easy by improving the structure so that the self-standing of the suction pipe may be maintained.

MODE OF THE INVENTION

Figure 1:
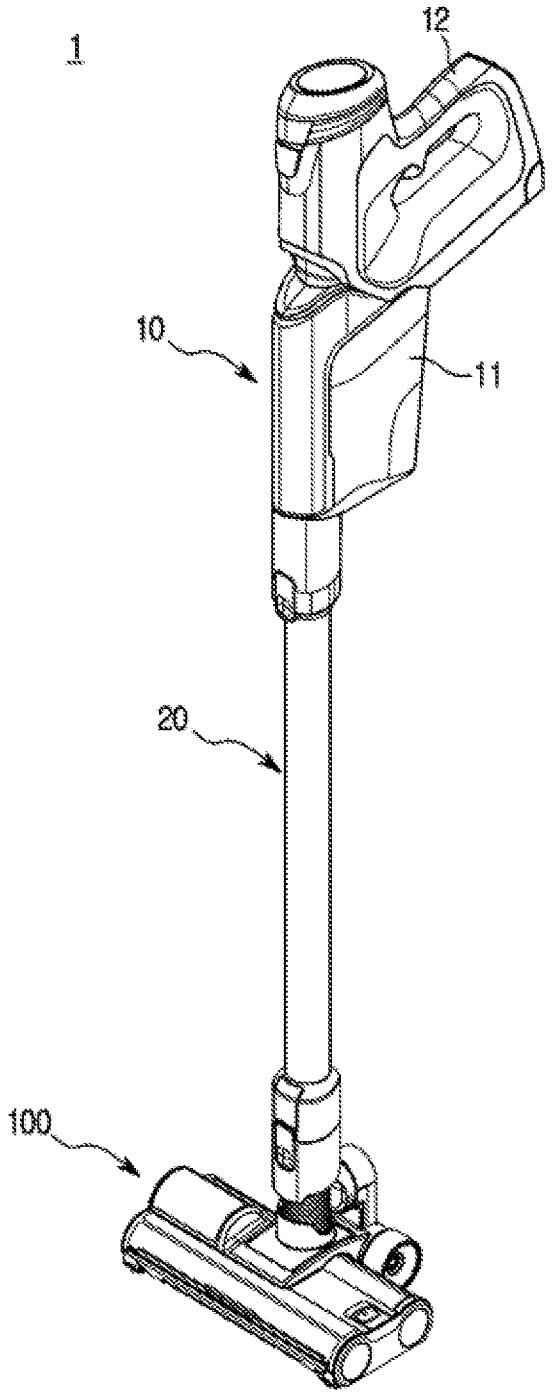
FIG. 1 is a perspective view of a cleaner according to an embodiment of the present disclosure.

The embodiments described in the present specification and the configurations shown in the drawings are only examples of preferred embodiments of the present disclosure, and various modifications may be made at the time of filing of the present disclosure to replace the embodiments and drawings of the present specification.

Like reference numbers or signs in the various drawings of the application represent parts or components that perform substantially the same functions. The terms used herein are for the purpose of describing the embodiments and are not intended to restrict and/or to limit the present disclosure.

The singular expressions herein may include plural expressions, unless the context clearly dictates otherwise. The terms "comprises" and "has" are intended to indicate that there are features, numbers, steps, operations, elements, parts, or combinations thereof described in the specification.

Accordingly, the above terms do not exclude the presence or addition of one or more other features, numbers, steps, operations, elements, parts, or combinations thereof.

It will be understood that, although the terms first, second, etc. may be used herein to describe various components, these components should not be limited by these terms. These terms are only used to distinguish one component from another.

For example, without departing from the scope of the present disclosure, the first component may be referred to as a second component, and similarly, the second component may also be referred to as a first component. The term "and/or" includes any combination of a plurality of related items or any one of a plurality of related items.

Hereinafter, embodiments of the present disclosure will be described in detail with reference to the accompanying drawings.

Figure 2:
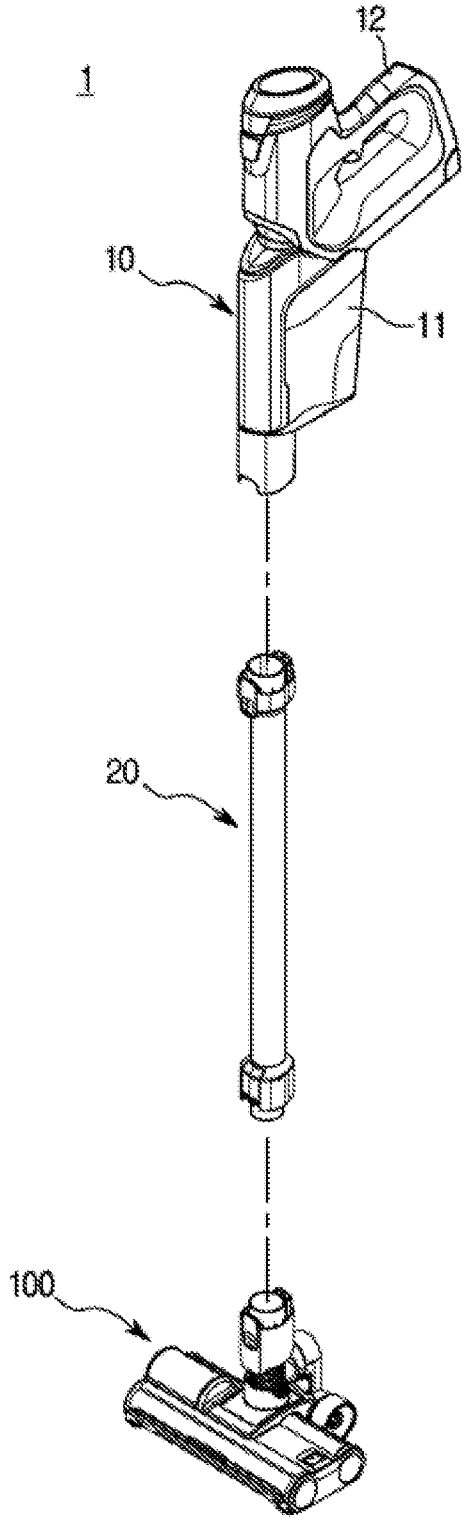
FIG. 2 is an exploded view of the cleaner according to an embodiment of the present disclosure.

FIG. 1 is a perspective view of a cleaner according to an embodiment of the present disclosure, and FIG. 2 is an exploded view of the cleaner according to an embodiment of the present disclosure.

As illustrated in FIGS. 1 and 2, a cleaner 1 may include a cleaner head 100 configured to suck foreign substances on the surface to be cleaned by an air suction force, and a cleaner main body 10 configured to collect foreign substances sucked through the cleaner head 100.

The cleaner 1 may include a suction pipe 20 configured to connect the cleaner head 100 and the cleaner main body 10.

The cleaner main body 10 may include a motor (not shown) configured to generate a suction force necessary to suck foreign substances present on the surface to be cleaned, and a dust collector 11 configured to collect foreign substances sucked from the surface to be cleaned.

The type of the dust collector 11 is not limited, and may be variously provided for example, such as a handle type cyclone dust collector. The dust collector 11 may include a filter (not shown).

The cleaner main body 10 may include a handle 12 configured to be gripped by a user. The user may grip the handle 12 and move the cleaner main body 10 and the cleaner head 100 in the front and rear directions.

The handle 12 may be provided with a switch (not shown). The switch (not shown) may be configured to receive an operation or stop of the cleaner 1 by the user's intention.

It may be appropriate that the switch (not shown) is disposed in the front of the handle 12 so that the user may operate the switch while moving the cleaner 1 when the cleaning proceeds.

The suction pipe 20 connected to the cleaner main body 10 may be connected to the cleaner head 100. The suction pipe 20 may be detachably connected to the cleaner head 100. The cleaner main body 10 may be detachably connected to the suction pipe 20.

The present embodiment exemplifies that the suction pipe 20 is integrally formed, but the present disclosure is not limited thereto. For example, the suction pipe 20 may be configured in a multistage manner or two of the suction pipes 20 may be connected.

The length between the cleaner head 100 and the cleaner main body 10 may be varied by the suction pipe 20.

The cleaner head 100 may be configured to suck foreign substances such as dust present on the surface to be cleaned while moving in contact with the surface to be cleaned. The cleaner head 100 may be connected to one end of the suction pipe 20.

Figure 3:
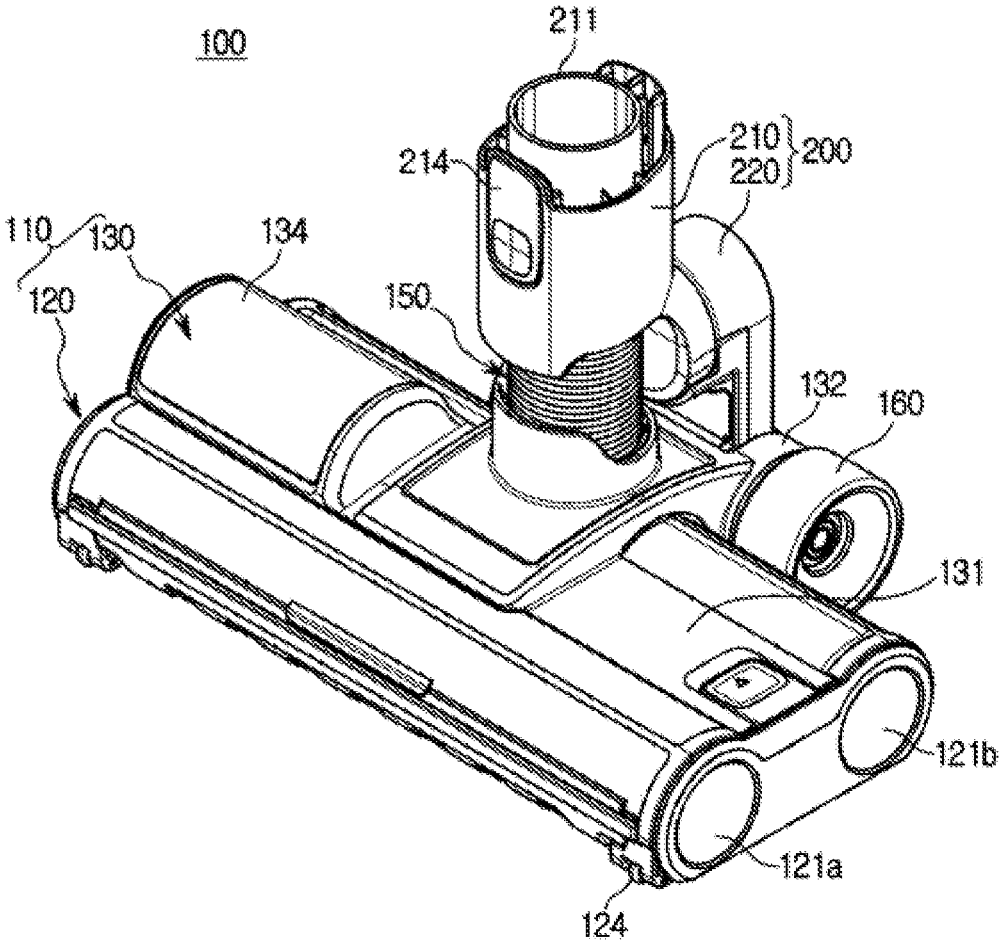
FIG. 3 is a front perspective view of a cleaner head in the cleaner according to an embodiment of the present disclosure.
Figure 4:
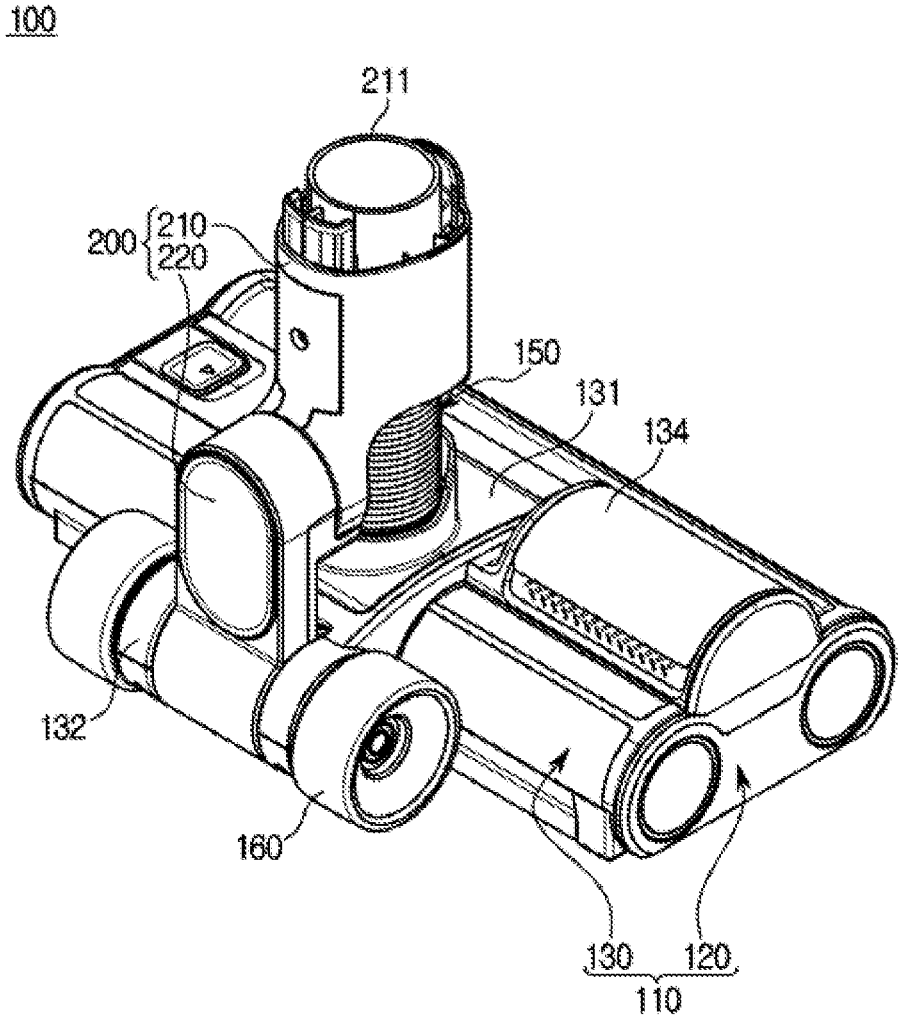
FIG. 4 is a rear perspective view of the cleaner head in the cleaner according to an embodiment of the present disclosure.
Figure 5:
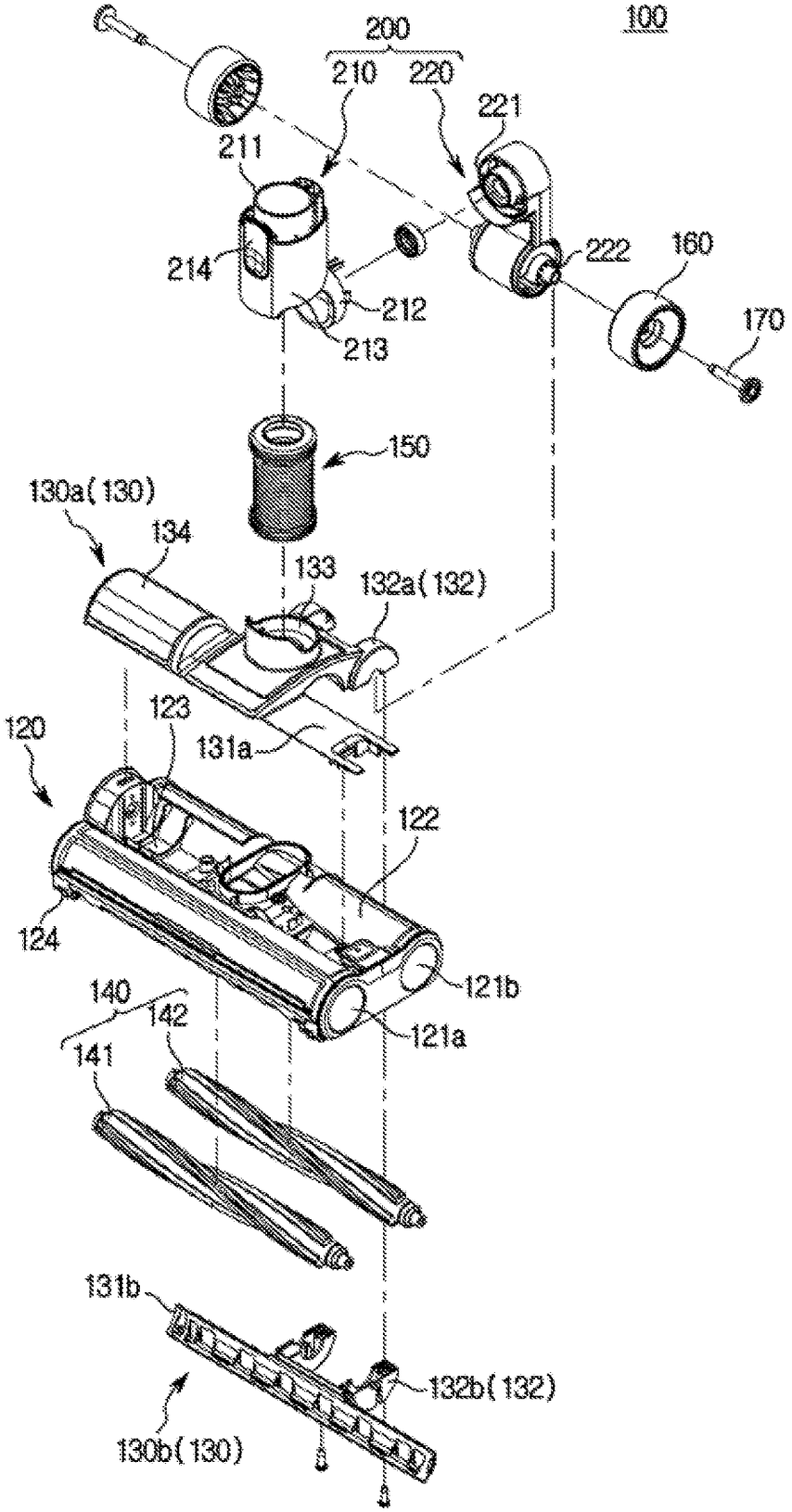
FIG. 5 is an exploded view of the cleaner head in the cleaner according to an embodiment of the present disclosure.

FIG. 3 is a front perspective view of a cleaner head in the cleaner according to an embodiment of the present disclosure, FIG. 4 is a rear perspective view of the cleaner head in the cleaner according to an embodiment of the present disclosure, and FIG. 5 is an exploded view of the cleaner head in the cleaner according to an embodiment of the present disclosure.

As illustrated in FIGS. 3 to 5, the cleaner head 100 may include a head main body 110 for receiving a brush 140. The brush 140 may be configured to facilitate suction of foreign substances on the surface to be cleaned into the suction pipe 20.

The head main body 110 may include a brush body 120 for receiving the brush 140 and a brush housing 130 for covering the brush body 120. The brush housing 130 may be coupled to the brush body 120 by a separate fastening member (not shown).

The brush 140 may be received at a lower portion of the brush body 120. The brush body 120 may be formed in a shape opened downward.

The brush body 120 may include a brush receiving portion 121 in which the brush 140 is received and a housing coupling portion 122 to which the brush housing 130 is coupled. The housing coupling portion 122 may be disposed in the rear of the brush receiving portion 121.

The brush 140 may include a front brush 141 and a rear brush 142 disposed in the rear of the front brush 141 in parallel with the front brush 141. However, the present disclosure is not limited thereto, and the number of brushes 140 may be variously provided.

The brush receiving portion 121 may include a front brush receiving portion 121*a* for receiving the front brush 141 and a rear brush receiving portion 121*b* for receiving the rear brush 142. However, the present disclosure is not limited thereto, and the brush receiving portion 121 may be variously provided to correspond to the number and shape of the brushes 140.

The brush body 120 may include a motor receiving portion 123 in which a driving motor (not shown) is received, and an auxiliary wheel 124 configured to move the head main body 110. The motor receiving portion 123 may be disposed between the front brush receiving portion 121*a* and the rear brush receiving portion 121*b*.

The auxiliary wheel 124 may be provided at a front lower surface of the head main body 110. The auxiliary wheel 124 may be provided at a front lower surface of the brush body 120.

Two of the auxiliary wheels 124 may be configured to face each other on opposite sides. However, the present disclosure is not limited thereto, and the position and number of the auxiliary wheels 124 may be variously provided within a limit capable of moving the head main body 110.

The brush housing 130 may include an upper brush housing 130*a* that may cover an upper portion of the brush body 120 and a lower brush housing 130*b* that may cover a lower portion of the brush body 120.

The upper brush housing 130*a* and the lower brush housing 130*b* may be coupled to each other with the brush body 120 interposed therebetween by a separate fastening member (not shown).

The brush housing 130 may include a first brush housing 131 configured to cover the brush body 120 and a second brush housing 132 configured to extend rearward from the first brush housing 131.

The second brush housing 132 may be configured to extend rearward from a middle portion of the first brush housing 131.

The brush housing 130 may include a motor housing 134 configured to cover the motor receiving portion 123 that receives the driving motor (not shown). The motor housing 134 may be configured to protrude upward from the first brush housing 131.

The motor housing 134 may be provided at one side of the first brush housing 131. However, the present disclosure is not limited thereto, and the shape and position of the motor housing 134 may be variously provided to correspond to the shape and position of the driving motor (not shown) received in the motor receiving portion 123.

The cleaner head 100 may include a hose 150 connected to a head main body 110. The hose 150 may be coupled to the brush housing 130. The hose 150 may be coupled to the upper brush housing 130*a*. The hose 150 may be coupled to the first brush housing 131.

The brush housing 130 may include a hose coupling portion 133 that is coupled to the hose 150. The hose coupling portion 133 may be formed in a circular shape open upward such that the hose 150 may be received therein.

However, the present disclosure is not limited thereto, and the shape of the hose coupling portion 133 may be variously provided to correspond to the shape of the hose 150.

The cleaner head 100 may include a connector 200 to connect the suction pipe 20 and the head main body 110. The connector 200 may connect the suction pipe 20 and the hose 150. The connector 200 may be disposed between the suction pipe 20 and the hose 150.

One end of the hose 150 may be connected to the connector 200, and the other end of the hose 150 may be connected to the hose coupling portion 133. One end of the connector 200 may be connected to the hose 150, and the other end of the connector 200 may be connected to the suction pipe 20.

The connector 200 may include a first connector 210 to connect the suction pipe 20 and the hose 150, and a second connector 220 to connect the first connector 210 and the brush housing 130.

The second connector 220 may connect the first connector 210 and the second brush housing 132. The second connector 220 may be rotatably coupled to a rear portion of the first connector 210. The second connector 220 may be positioned in the rear of the brush body 120.

The second brush housing 132 may be configured to protrude from opposite sides of the first brush housing 131. The second connector 220 may be coupled to the second brush housings 132 so as to be disposed between the second brush housings 132.

The cleaner head 100 may include a main wheel 160 configured to allow the cleaner head 100 to move, together with the auxiliary wheel 124. The main wheel 160 may be coupled to the head main body 110 to be positioned in the rear of the brush 140.

The main wheel 160 may be rotatably coupled to the brush housing 130. The main wheel 160 may be rotatably coupled to the second brush housing 132.

The cleaner head 100 may include a rotation shaft 170 to rotatably couple the main wheel 160 to the second brush housing 132. Two of the main wheels 160 and two of the rotation shafts 170 may be provided to correspond to opposite sides of the second brush housing 132.

However, the present disclosure is not limited thereto, and the number of the main wheels 160 and the rotation shafts 170 may be variously provided within limits capable of moving the cleaner head 100 together with the auxiliary wheel 124.

The first connector 210 may include a suction pipe coupling portion 211 detachably coupled to the suction pipe 20 and a second connector coupling portion 212 rotatably coupled to the second connector 220.

The first connector 210 may include a hose receiving portion 213 configured to receive the hose 150 and a coupling member 214 configured to connect and disconnect the suction pipe 20 and the first connector 210.

The suction pipe coupling portion 211 and the hose receiving portion 213 may be disposed to face each other. The suction pipe coupling portion 211 and the hose receiving portion 213 may include an opening, and the first connector 210 may be formed in a substantially cylindrical shape including an opened upper portion and a lower portion.

The second connector coupling portion 212 may protrude from a rear surface of the first connector 210 to be coupled to the second connector 220.

The coupling member 214 may couple the suction pipe 20 and the suction pipe coupling portion 211 and release the coupling of the suction pipe 20 and the suction pipe coupling portion 211.

The second connector 220 may include a first connector coupling portion 221 that is coupled to the first connector 210 and a rotation portion 222 that is rotatably coupled to the second brush housing 132.

The first connector coupling portion 221 may be configured to have a shape corresponding to the second connector coupling portion 212. The first connector coupling portion 221 may be formed to extend upward from the rotation portion 222.

The rotation portion 222 may be coupled to the brush housing 130. The rotation portion 222 may be coupled to the second brush housing 132. The rotation shaft 170 may penetrate coaxially through the main wheel 160, the second brush housing 132, and the rotation portion 222.

The second connector 220 and the main wheel 160 may be rotatably arranged coaxially. The main wheel 160, the second brush housing 132, and the second connector 220 may be horizontally connected in a straight line.

The suction pipe 20 coupled to the connector 200 may be disposed between the brush 140 and the main wheel 160 to enable self-standing of the suction pipe 20. The suction pipe 20 may be disposed between the front brush 141 and the main wheel 160.

The suction pipe 20 and the connector 200 may be coupled to be positioned perpendicular to the surface to be cleaned. The suction pipe 20 may be vertically positioned above the rear brush 142.

That is, in the cleaner 1 according to the present disclosure, the suction pipe 20 may be configured to be vertically disposed from the surface to be cleaned, and the suction pipe 20 is not connected to the rearmost portion of the cleaner head 100, but may be disposed between the front brush 141 and the main wheel 160.

Therefore, the position of the suction pipe 20 may be adjacent to a middle portion of the cleaner head 100 instead of the rearmost portion of the cleaner head 100, and the suction pipe 20 may be vertically coupled to the head main body 110, so that the suction pipe 20 may be capable of self-standing from the head main body 110.

The cleaner head 100 may include the hose 150 having an elasticity such that the suction pipe 20 maintains a self-standing state. The hose 150 may include a bellows with pleats, but is not limited thereto.

Because the hose 150 of the cleaner 1 according to the present disclosure has an elastic force, the self-standing of the connector 200 connected to the hose 150 and the suction pipe 20 connected to the connector 200 may be maintained.

Therefore, even when a predetermined external force acts on the suction pipe 20, the suction pipe 20 is returned to its original position by the elastic force of the hose 150, so that the self-standing of the suction pipe 20 may be maintained.

Although the self-standing of the suction pipe 20 may be possible when the connector 200 to which the suction pipe 20 is connected is directly connected to the head main body 110 without the hose 150, when a predetermined external force is applied, the self-standing of the suction pipe 20 may be difficult to be maintained.

In addition, in this case, since the suction pipe 20 may not be rotated, it may cause great inconvenience to the user who performs the cleaning using the cleaner 1.

The first connector 210 may be positioned vertically in a straight line with the hose 150 and the suction pipe 20, and the second connector 220 may be disposed above the main wheel 160.

Figure 6:
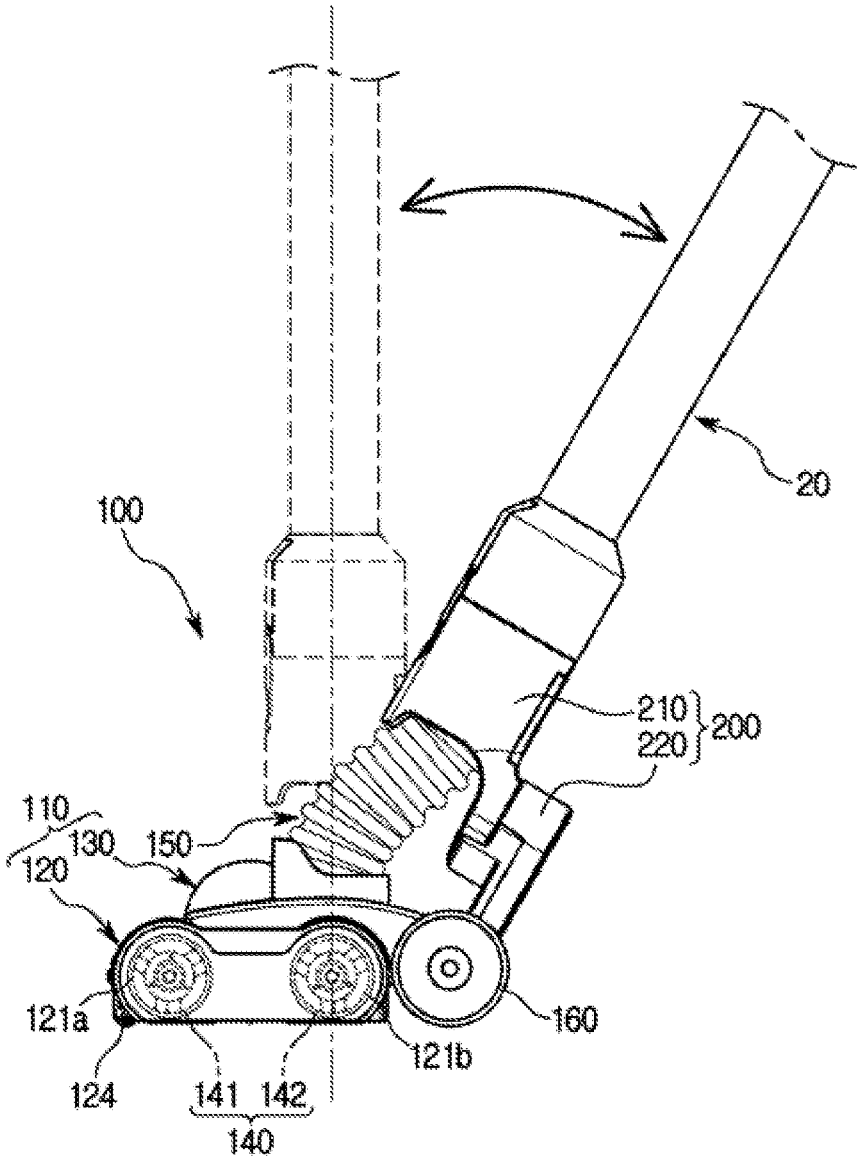
FIG. 6 is a view illustrating an operation of rotating a suction pipe back and forth in the cleaner according to an embodiment of the present disclosure.

FIG. 6 is a view illustrating an operation of rotating the suction pipe back and forth in the cleaner according to an embodiment of the present disclosure. As illustrated in FIG. 6, the suction pipe 20 may be disposed vertically above the rear brush 142 to maintain the self-standing in a state in which no external force is applied to the suction pipe 20.

The hose 150 may be flexibly configured to allow the suction pipe 20 to rotate in the front and rear directions. The second connector 220 may be rotatably coupled to the brush housing 130 to allow the suction pipe 20 to rotate in the front and rear directions.

The rotation portion 222 may be rotatably coupled to the second brush housing 132 to allow the suction pipe 20 to rotate in the front and rear directions. The suction pipe 20 and the second connector 220 may rotate in the front and rear directions by the rotation shaft 170.

The suction pipe 20 and the connector 200 connected to the suction pipe 20 may rotate about the rotation shaft 170.

Therefore, unlike a case where the hose 150 is not included, the rotation of the suction pipe 20 in the front and rear directions is possible by the flexible hose 150, so that the user may easily clean the surface to be cleaned using the cleaner 1.

Figure 7:
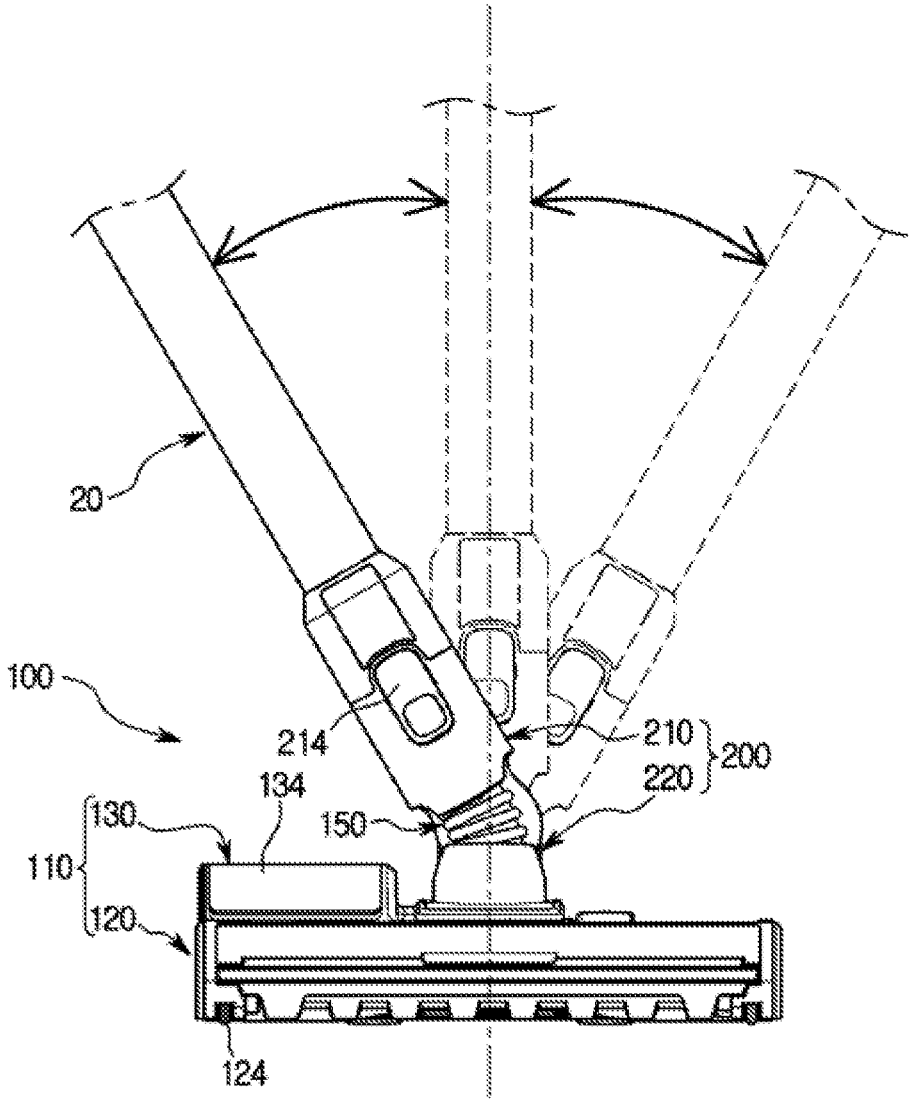
FIG. 7 is a view illustrating an operation of rotating the suction pipe left and right in the cleaner according to an embodiment of the present disclosure.

FIG. 7 is a view illustrating an operation of rotating the suction pipe left and right in the cleaner according to an embodiment of the present disclosure. As illustrated in FIG. 7, the suction pipe 20 may be disposed vertically above the head main body 110 to maintain the self-standing in a state in which no external force is applied to the suction pipe 20.

The hose 150 may be flexibly configured to allow the suction pipe 20 to rotate in the left and right directions. The first connector 210 may be rotatably coupled to the second connector 220 to allow the suction pipe 20 to rotate in the left and right directions.

The second connector coupling portion 212 may be rotatably coupled to the first connector coupling portion 221 to allow the suction pipe 20 to rotate in the front and rear directions.

The first connector 210 may be rotatably coupled to the second connector 220 using the centers of the second connector coupling portion 212 and the first connector coupling portion 221 as a rotation axis.

Therefore, unlike a case where the hose 150 is not included, the rotation of the suction pipe 20 in the front and rear directions is possible by the flexible hose 150, so that the user may easily clean the surface to be cleaned using the cleaner 1.

Figure 8:
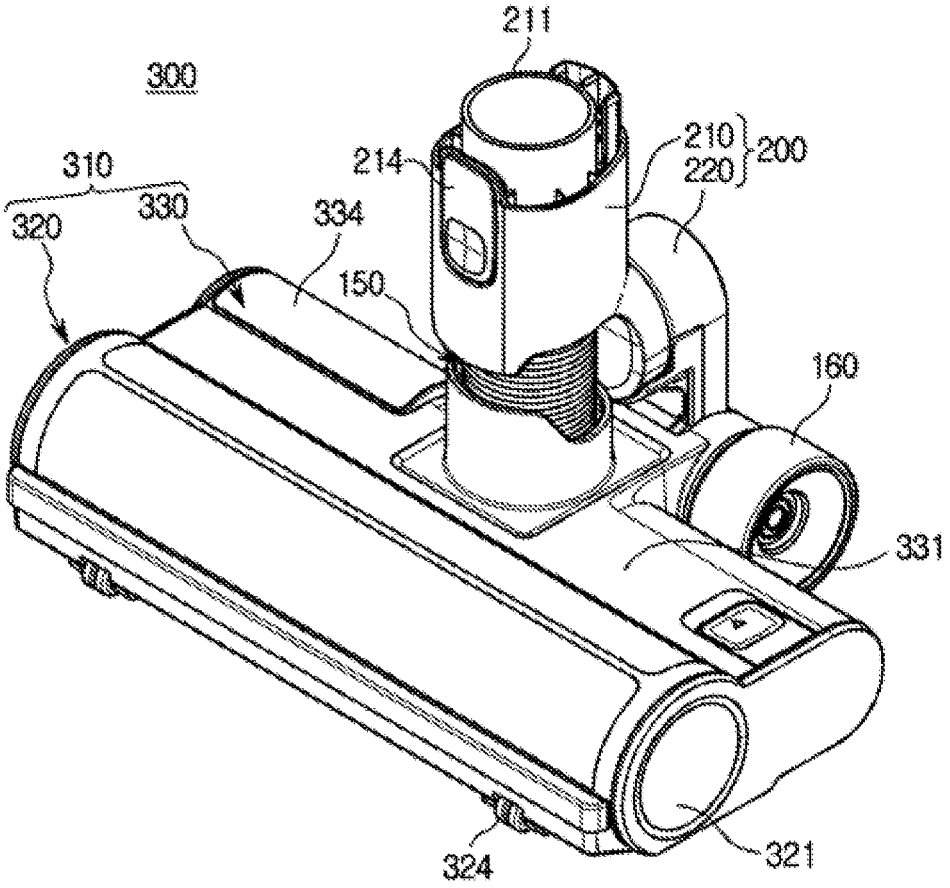
FIG. 8 is a perspective view of a cleaner according to another embodiment of the present disclosure.
Figure 9:
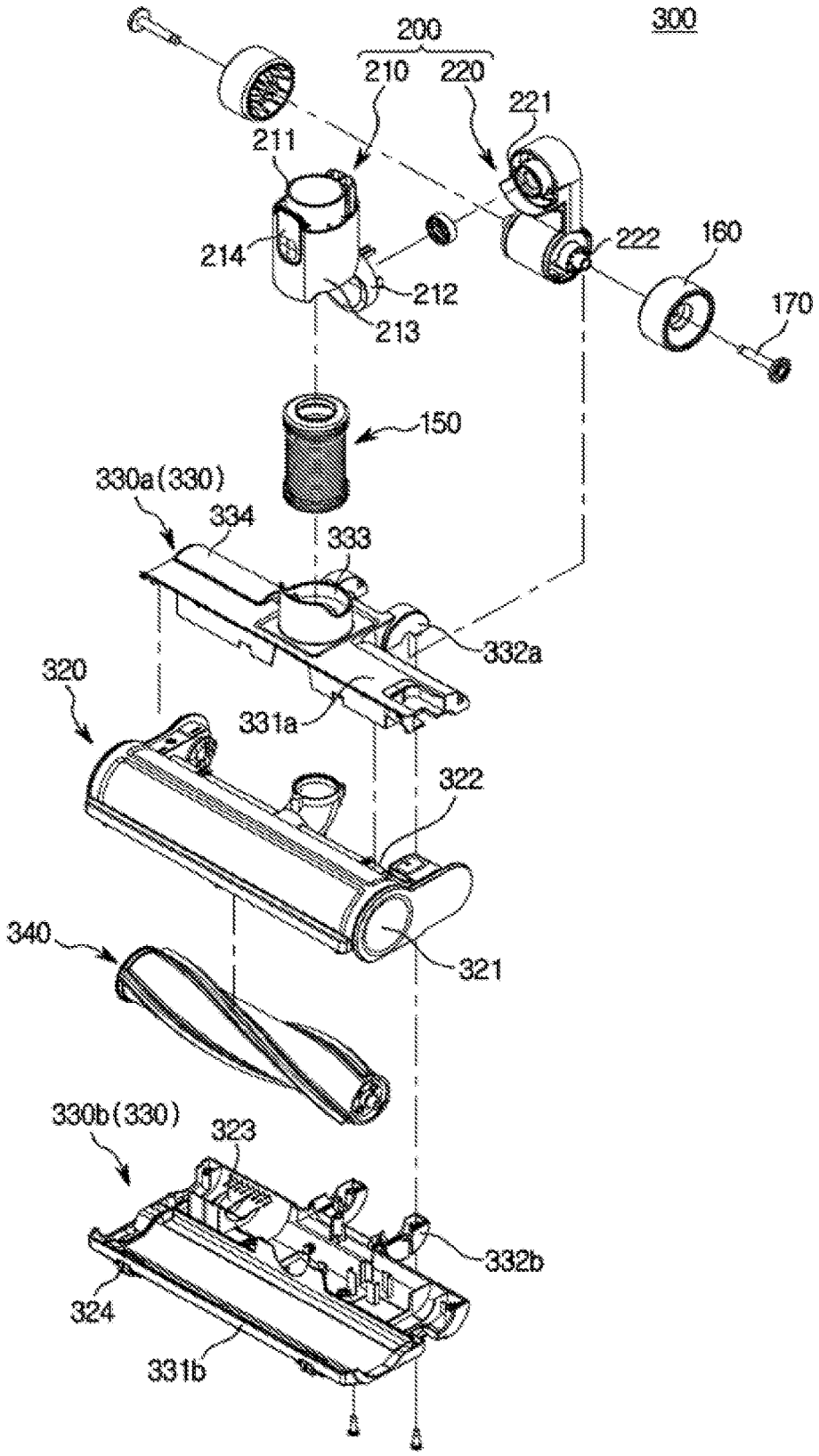
FIG. 9 is an exploded view of a cleaner head in the cleaner according to the embodiment illustrated in FIG. 8.

FIG. 8 is a perspective view of a cleaner according to another embodiment of the present disclosure, and FIG. 9 is an exploded view of a cleaner head in the cleaner according to the embodiment illustrated in FIG. 8.

Two of the embodiments differ in that a cleaner head 300 according to another embodiment of the present disclosure may include a single brush 340 while the cleaner head 100 according to an embodiment of the present disclosure may include the front brush 141 and the rear brush 142.

The description of the cleaner head 300 according to another embodiment of the present disclosure, which is redundant with the description of the cleaner head 100 according to an embodiment of the present disclosure, will be omitted.

As illustrated in FIGS. 8 and 9, the cleaner head 300 may include a head main body 310 to receive the brush 340. The brush 340 may be configured to allow foreign substances on the surface to be cleaned to be sucked into the suction pipe 20.

The head main body 310 may include a brush body 320 to receive the brush 340 and a brush housing 330 to cover the brush body 320. The brush housing 330 may be coupled to the brush body 320 by a separate fastening member (not shown).

The brush 340 may be received at a lower portion of the brush body 320. The brush body 320 may be formed in a shape that is opened downward.

The brush body 320 may include a brush receiving portion 321 in which the brush 340 is received and a housing coupling portion 322 to which the brush housing 330 is coupled.

The size of the brush 340 of the cleaner head 300 according to another embodiment of the present disclosure may be larger than that of the brush 140 of the cleaner head 100 according to an embodiment of the present disclosure. However, the present disclosure is not limited thereto.

The brush housing 330 may include an upper brush housing 330*a* that may cover an upper portion of the brush body 320 and a lower brush housing 330*b* that may cover a lower portion of the brush body 320.

The upper brush housing 330*a* and the lower brush housing 330*b* may be coupled to each other with the brush body 320 interposed therebetween by a separate fastening member (not shown).

The size of the lower brush housing 330*b* according to another embodiment of the present disclosure may be larger than that of the lower brush housing 130*b* according to an embodiment of the present disclosure. However, the present disclosure is not limited thereto.

The brush housing 330 may include a first brush housing 331 covering the brush body 320 and a second brush housing 332 extending rearward from the first brush housing 331.

The lower brush housing 330*b* may include a motor receiving portion 323 in which a driving motor (not shown) is received, and an auxiliary wheel 324 configured to move the head main body 310. The motor receiving portion 323 may be disposed in the rear of the brush receiving portion 321.

The auxiliary wheel 324 may be provided at a front lower surface of the head main body 310. Two of the auxiliary wheels 324 may be configured to face each other. However, the present disclosure is not limited thereto, and the position and number of the auxiliary wheels 324 may be variously provided within a limit capable of moving the head main body 310.

The upper brush housing 330*a* may include a motor housing 334 to cover the motor receiving portion 323 that receives the driving motor (not shown). The motor housing 334 may be configured to protrude upward from the first brush housing 331.

However, the present disclosure is not limited thereto, and the motor housing 334 may be variously provided to correspond to the shape of the driving motor (not shown) received in the motor receiving portion 323.

The cleaner head 300 may include the hose 150 connected to the head main body 310. The hose 150 may be coupled to the brush housing 330. The hose 150 may be coupled to the upper brush housing 330*a*. The hose 150 may be coupled to the first brush housing 331.

The brush housing 330 may include a hose coupling portion 333 that is coupled to the hose 150. The hose coupling portion 333 may be formed in a circular shape open upward such that the hose 150 may be received therein. However, the present disclosure is not limited thereto, and the shape of the hose coupling portion 333 may be variously provided to correspond to the shape of the hose 150.

The cleaner head 300 may include the connector 200 to connect the suction pipe 20 and the head main body 310. One end of the hose 150 may be connected to the connector 200, and the other end of the hose 150 may be connected to the hose coupling portion 133. One end of the connector 200 may be connected to the hose 150, and the other end of the connector 200 may be connected to the hose coupling portion 333.

The connector 200 may include the first connector 210 to connect the suction pipe 20 and the hose 150, and the second connector 220 to connect the first connector 210 and the brush housing 330.

The second connector 220 may connect the first connector 210 and the second brush housing 332. The second connector 220 may be positioned in the rear of the brush body 320.

The second connector 220 may be coupled to the second brush housings 332 so as to be disposed between the second brush housings 332.

The cleaner head 300 may include the main wheel 160 configured to allow the cleaner head 100 to move, together with the auxiliary wheel 324. The main wheel 160 may be coupled to the head main body 310 to be positioned in the rear of the brush 340.

The main wheel 160 may be rotatably coupled to the brush housing 330. The main wheel 160 may be coupled to the second brush housing 332.

The cleaner head 300 may include the rotation shaft 170 to rotatably couple the main wheel 160 to the second brush housing 332. Two of the main wheels 160 and two of the rotation shafts 170 may be provided to correspond to opposite sides of the second brush housing 332.

However, the present disclosure is not limited thereto, and the number of the main wheels 160 and the rotation shafts 170 may be variously provided within limits capable of moving the cleaner head 300 together with the auxiliary wheel 324.

The second connector 220 may include the first connector coupling portion 221 coupled to the first connector 210 and the rotation portion 222 rotatably coupled to the second brush housing 332.

The rotation portion 222 may be coupled to the brush housing 330. The rotation portion 222 may be coupled to the second brush housing 332. The rotation shaft 170 may penetrate coaxially through the main wheel 160, the second brush housing 332, and the rotation portion 222.

The second connector 220 and the main wheel 160 may be rotatably arranged coaxially. The main wheel 160, the second brush housing 332, and the second connector 220 may be horizontally connected in a straight line.

The suction pipe 20 coupled to the connector 200 may be disposed between the brush 140 and the main wheel 160 to enable self-standing of the suction pipe 20.

Figure 10:
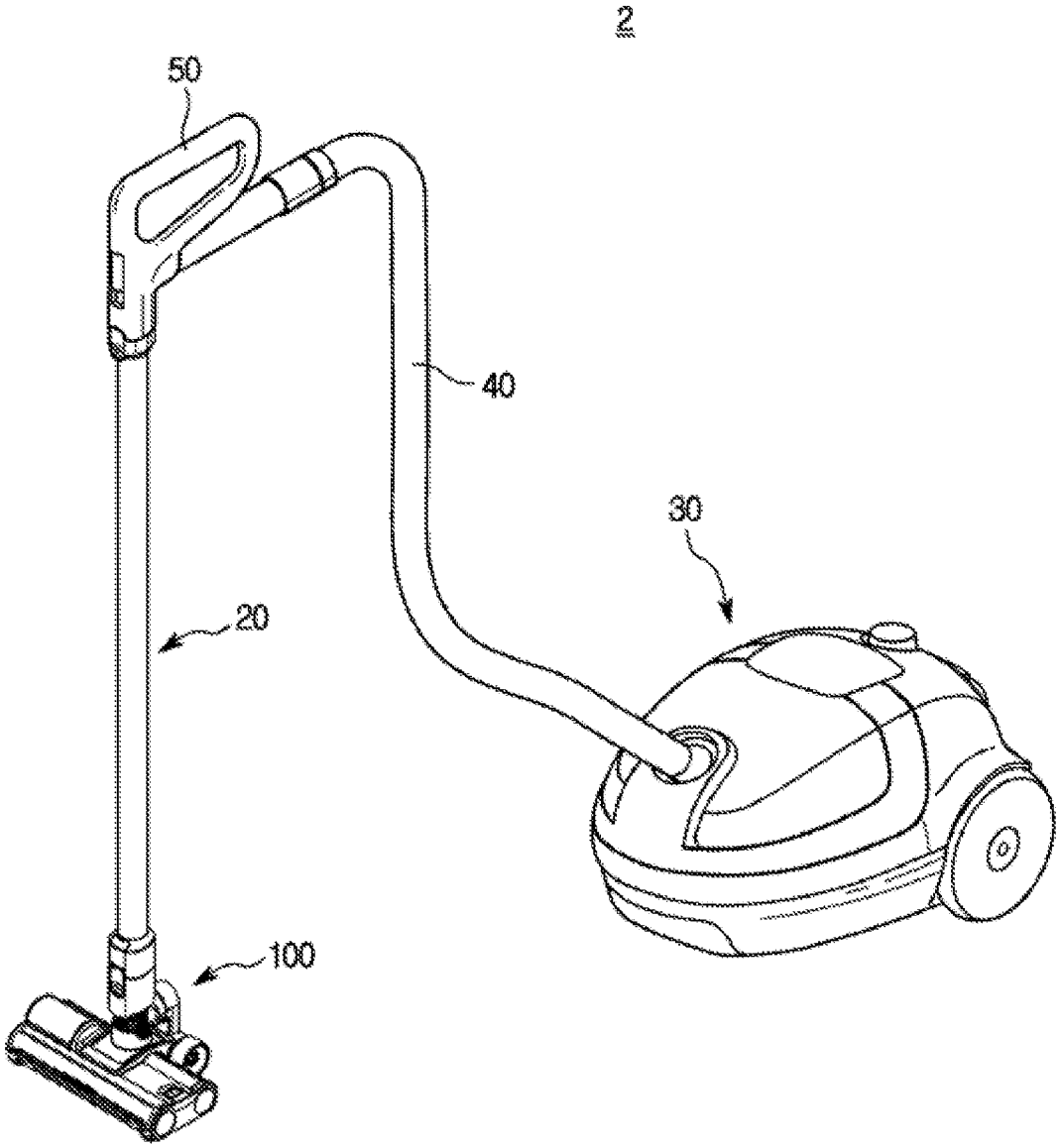
FIG. 10 is a perspective view of a cleaner according to another embodiment of the present disclosure.

FIG. 10 is a perspective view of a cleaner according to another embodiment of the present disclosure. As illustrated in FIG. 10, a cleaner 2 according to another embodiment of the present disclosure may include a canister type cleaner.

The cleaner 2 may include a cleaner main body 30 and a dust collector (not shown) mounted to the cleaner main body 30. The cleaner main body 30 may include main components to drive the cleaner 2.

The dust collector (not shown) may collect the foreign substances sucked from the surface to be cleaned by using the cleaner 2.

The cleaner 2 may include the cleaner head 100 in contact with the surface to be cleaned. The cleaner head 100 may suck foreign substances from the surface to be cleaned.

The cleaner main body 30 may include a fan motor (not shown) to generate a suction force. By the suction force generated in the fan motor (not shown) of the cleaner main body 30, the cleaner head 100 may suck foreign substances on the surface to be cleaned. The cleaner head 100 may be provided to be in close contact with the surface to be cleaned.

The cleaner 2 may include the suction pipe 20 positioned in the rear of the cleaner head 100 to connect the cleaner main body 30 to the cleaner head 100. The rear of the cleaner head 100 may be defined as a direction from the cleaner head 100 toward the user when the user uses the cleaner 2.

The suction pipe 20 may include a metal material. The cleaner 2 may include an extension hose 40 connected to the cleaner main body 30 and made of a flexible resin material. A handle pipe 50 may be provided between the suction pipe 20 and the extension hose 40.

It is appropriate that the extension hose 40 is formed of an elastic corrugated pipe, and one end of the extension hose 40 may be connected to the cleaner main body 30 and the other end may be connected to the handle pipe 50. The extension hose 40 may allow the cleaner head 100 to move freely within a predetermined radius about the cleaner main body 30.

The suction pipe 20, the handle pipe 50 and the extension hose 40 may all be configured to communicate. The air sucked through the cleaner head 100 may sequentially pass through the suction pipe 20, the handle pipe 50, and the extension hose 40 to be introduced into the cleaner main body 30.

The user may move the cleaner head 100 by holding the handle pipe 50 and applying a force to the handle pipe 50.

The technical spirit of the present disclosure has been described above, but the scope of the present disclosure is not limited thereto.

It will be understood by those of skilled in the art that various changes in form and details may be made without departing from the spirit and scope of the present disclosure.

The invention claimed is:

1. A cleaner comprising:

a head main body including a brush;

a main wheel directly coupled to the head main body to be positioned in a rear of the brush, the main wheel coupled at a fixed distance from the head main body;

a suction pipe disposed between the brush and the main wheel to enable self-standing;

a connector configured to connect the suction pipe and the head main body; and a hose having an elasticity such that the suction pipe maintains a self-standing state and disposed between the head main body and the connector, wherein the connector includes a first connector to connect the suction pipe and the hose and a second connector to connect the first connector and the head main body, and wherein the second connector is provided in a rear of the first connector.

2. The cleaner according to claim 1, wherein the brush includes a front brush and a rear brush disposed in a rear of the front brush in parallel with the front brush, and wherein the suction pipe is disposed between the front brush and the main wheel.

3. The cleaner according to claim 2, wherein the suction pipe is positioned vertically above the rear brush.

4. The cleaner according to claim 1, wherein the hose and the suction pipe are positioned vertically in a straight line.

5. The cleaner according to claim 1, wherein the hose includes a bellows with pleats.

6. The cleaner according to claim 1, wherein the head main body includes a brush body to receive the brush and a brush housing to cover the brush body, and wherein the main wheel is rotatably coupled to the brush housing.

7. The cleaner according to claim 6, wherein the second connector connects the first connector and the brush housing.

8. The cleaner according to claim 7, wherein the second connector is rotatably coupled to the brush housing to allow the suction pipe to rotate in front and rear directions.

9. The cleaner according to claim 7, wherein the second connector and the main wheel are rotatably arranged coaxially.

10. The cleaner according to claim 7, wherein the brush housing comprises:

a first brush housing configured to cover the brush body, and a second brush housing configured to extend rearward from the first brush housing, and wherein the main wheel, the second brush housing and the second connector are horizontally positioned in a straight line.

11. The cleaner according to claim 10, wherein one end of the hose is coupled to the first brush housing, and another end of the hose is coupled to the first connector.

12. The cleaner according to claim 10, wherein the second connector comprises:

a first connector coupling portion coupled to the first connector, and a rotation portion rotatably coupled to the second brush housing.

13. The cleaner according to claim 7, wherein the first connector is rotatably coupled to the second connector to allow the suction pipe to rotate in left and right directions.

14. The cleaner according to claim 7, wherein the first connector is positioned vertically in a straight line with the hose and the suction pipe, and the second connector is disposed above the main wheel.

15. The cleaner according to claim 7, wherein the first connector comprises:

a suction pipe coupling portion detachably coupled to the suction pipe, a second connector coupling portion rotatably coupled to the second connector, and a hose receiving portion to receive the hose.

16. The cleaner according to claim 1, wherein the elasticity of the hose is such that when a predetermined external force acts on the suction pipe, the suction pipe is returned to a substantially upright position by an elastic force of the hose.

* * * * *